US006644402B1

(12) United States Patent
Sharma et al.

(10) Patent No.: US 6,644,402 B1
(45) Date of Patent: Nov. 11, 2003

(54) METHOD OF INSTALLING A SENSOR IN A WELL

(75) Inventors: Sandeep Sharma, Dalkeith (AU); John Godsman, Peppermint Grove (AU); Eric Larson, Sugar Land, TX (US); Pat Foale, Bangkok (TH)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/913,379

(22) PCT Filed: Feb. 16, 1999

(86) PCT No.: PCT/IB99/00270

§ 371 (c)(1),
(2), (4) Date: May 27, 2002

(87) PCT Pub. No.: WO00/49273

PCT Pub. Date: Aug. 24, 2000

(Under 37 CFR 1.47)

(51) Int. Cl.[7] ..... E21B 47/00
(52) U.S. Cl. ..... 166/250.01; 175/50
(58) Field of Search ..... 175/40, 50; 166/250.01, 166/66

(56) References Cited

U.S. PATENT DOCUMENTS

| | | | | |
|---|---|---|---|---|
| 5,285,204 A | * | 2/1994 | Sas-Jaworsky | 340/854.9 |
| 5,291,956 A | | 3/1994 | Mueller et al. | |
| 5,542,472 A | | 8/1996 | Pringle et al. | |
| 5,804,713 A | | 9/1998 | Kluth | |
| 5,860,483 A | | 1/1999 | Havig | |
| 6,325,161 B1 | * | 12/2001 | Havig | 175/40 |

FOREIGN PATENT DOCUMENTS

GB 2 311 546 10/1997

* cited by examiner

*Primary Examiner*—William Neuder
*Assistant Examiner*—Jennifer Dougherty
(74) *Attorney, Agent, or Firm*—Robin Nava; Brigitte Jeffery; John Ryberg

(57) ABSTRACT

Coiled tubing (120) is used to drill into a subsurface formation and provide a conduit back to the surface to allow sensors (200) to be deployed and measurements made for monitoring of the formation. A method of monitoring subsurface formation properties between injection and production wells comprises using coiled tubing (120) to drill sensor holes at predetermined positions between the injection and production wells and fixing the coiled tubing permanently in the hole such that a sensor (200) can be deployed in the tubing to provide measurements of the formation.

20 Claims, 5 Drawing Sheets

METHOD OF INSTALLING A SENSOR IN A WELL

TECHNICAL FIELD

The present invention relates to methods and systems for placing sensors beneath the earth's surface to allow monitoring of subsurface properties. In particular, the invention relates to methods and systems for monitoring the movement of fluids in reservoirs, such as hydrocarbon reservoirs.

BACKGROUND ART

In certain situations, it is desirable to provide sensors for long term or permanent monitoring of subsurface formations. Examples include environmental monitoring, water flow monitoring, seismic monitoring and hydrocarbon reservoir management. In the latter case, the information obtained from permanent or long term monitoring is used to manage the production from the wells in a given region in order to optimise oil or gas recovery. A review of permanent monitoring applications is given in the article Permanent Monitoring-Looking at Lifetime Reservoir Dynamics published in Oilfield Review, Winter 1995 pp. 32–46.

There have been certain proposals for installation of permanent sensors in oil or gas wells or for the monitoring of hydrocarbon reservoirs. One example is found in U.S. Pat. No. 5,662,165 which describes a downhole control system for a production well which is associated with permanent downhole formation evaluation sensors such as neutron generator, gamma ray detector and resistivity sensors. The data retrieved from the sensors can be used to determine corrective action to be taken to maintain effective production from the well. Since the sensors are placed in the producing well, the depth of investigation into the formation is limited by the depth of investigation of a given sensor. Thus effective measurement of far field properties is prevented. The disadvantage in this approach is that it in only possible to react to a change experienced very close to a given well, not to anticipate the change and take preventative action. Other disadvantages are that the presence of casing can interfere with a measurement. It has been proposed to install sensors behind casing but these are susceptible to damage during perforating and still are incapable of making far field measurements. WO 98/50680 and WO 98/50681 describe the use of fibre-optic based sensors in permanent installations to monitor formations surrounding producing wells. While the sensors are relatively cheap and long-lived, they still suffer from the inability to see into the far-field of the well.

In certain reservoirs, it is necessary to attempt to provide some means for driving the in situ hydrocarbons into the producing well. This is known as "secondary recovery" and two common examples of this are water flooding and steam flooding. In such cases, water or steam are injected into the formation through one or more injection wells placed some distance from the producing well(s) and move through the formation to the producing wells, driving the oil in front of it. In the case of steam, the heat provided also improves the mobility of the oil in the formation. On problem with such methods is that often the flood front reaches the production well bypassing oil in the formation (this is sometimes known as "breakthrough"). In order to control the process to avoid breakthrough it is desirable to monitor the progress of the flood front. However, monitoring from the production well as described above does not see far enough into the formation to allow remedial action to be taken to prevent breakthrough.

In steam flood secondary recovery, one measurement which has been made is that of temperature near the producing well(s) to determine the approach of the steam front. Other measurements which might be useful are: pressure, mechanical and electrical properties of the formation. FIG. 1 shows one system for measuring temperature in which a U-shaped 0.25" stainless steel tube 10 is run along the outside of the production well casing 12 where it is cemented in place with the casing in the hole 14. A fibre optic sensor 16 is then installed by pumping nitrogen through the U-tube 10 until the fibre 16 is in place, at which time temperature measurements can be made by connecting the ends of the fibre 16 to a source and receiver instrument 18 at the surface. The potential for damage to the U-tube is high, either in the installation process, or during perforating and again, only near-field measurements can be made.

One approach to avoiding the problem of making far field measurements is found in WO 98/15850 which proposes the drilling of non-producing boreholes for positioning permanent seismic monitoring sensors. The trajectories of the boreholes are chosen to optimise the response of the sensors to seismic signals rather than production from the reservoir. Seismic measurements should be able to monitor the flood front, particularly a steam flood front. However, the requirement to drill horizontal boreholes makes the drilling of these boreholes a relatively complex and expensive proposition. In order to accommodate seismic sensors, it is necessary for the borehole to have a sufficiently large size in view of the size and physical requirements of the systems used. Furthermore, making seismic measurements is relatively expensive and time consuming and is not applicable to a permanent monitoring solution.

Most boreholes are constructed using the well-known rotary drilling technique common in the oil and gas industry. One alternative when drilling smaller diameter holes is to use a technique called coiled-tubing drilling in which a drilling bottom hole assembly (BHA) is connected to the end of a continuous tubing through which a fluid is pumped to drive a downhole motor in the BHA to turn the drill bit. The basic technique is reviewed in the article entitled An Early Look at Coiled-Tubing Drilling published in Oilfield Review, July 1992, pp. 45–51. While the technique has been applied mainly to re-entry drilling, new exploration wells have been drilling using this approach. Coiled tubing has also been used to convey logging instruments into boreholes and to place fluids or equipment at precise locations in boreholes. One approach to long term monitoring is found in U.S. Pat. No. 5,860,483 which describes the use of coiled tubing to drill holes for locating seismic sensors. The seismic sensors are mounted on the outside of the coiled tubing. After drilling, the coiled tubing is withdrawn from the hole and the drilling tools removed. It is then reinserted into the hole, which can be allowed to collapse around it.

The present invention attempts to provide a solution to far-field monitoring of formations surrounding producing boreholes, especially in cases where enhanced recovery techniques are used.

DISCLOSURE OF INVENTION

The present invention resides in the use of coiled tubing to drill into the formation and provide a conduit back to the surface to allow sensors to be deployed and measurements made for monitoring of the formation.

One aspect of the invention provides a method of monitoring subsurface formation properties between injection and production wells. In this method, coiled-tubing is used to drill sensor holes at predetermined positions between the injection and production wells and the coiled-tubing is permanently fixed in the hole such that a sensor can be deployed in the tubing to provide measurements of the formation.

Various options are available within the scope of this method. Typically, a bottom hole assembly incorporating drilling tools will be attached to the coiled tubing for use in drilling the hole. When the hole has been drilled to depth, the coiled tubing can be withdrawn, the BHA removed and the tubing reinserted into the hole where it is cemented in place. Alternatively, a different coiled tubing can be installed in the hole. Also, the BHA can be left in the hole so that it is not necessary to withdraw the tubing from the hole before completion. The particular option chosen will depend on matters such as cost, convenience, nature of sensors used, etc.

For monitoring progress of steam flood, it is convenient to use a continuous fibre optic sensor which measures temperature. The particularly preferred option is a fibre optic sensor which runs from the surface, down the length of the coiled-tubing and back to the surface (i.e. and elongated "U" shape). Such sensors can either be permanently installed in the coiled-tubing or can be deployed on a temporary basis in each coiled tubing in turn. In the former case, the sensor can be located in the coiled-tubing used to drill the hole, whether the BHA is left in situ or removed. In the latter case, the fibre optic sensor can be attached to a plug which is pumped down the coiled tubing. After the measurement has been made, the plug can be detached and the fibre optic sensor retrieved and used again in another well. In another embodiment, sensor tubes are run into the coiled tubing and the sensors pumped along these so as to be positioned in the formation when required. A single sensor tube or a double, U-shaped tube can be used as appropriate.

Another aspect of the invention provides a method of monitoring a steam flood operation comprising positioning a number of sensor holes between one or more injection wells and one or more producing wells using a method as described above and measuring the temperature of the subsurface formation either continuously or from time to time using a fibre optic sensor deployed in each hole.

BEST MODE FOR CARRYING OUT THE INVENTION

Figure 1:
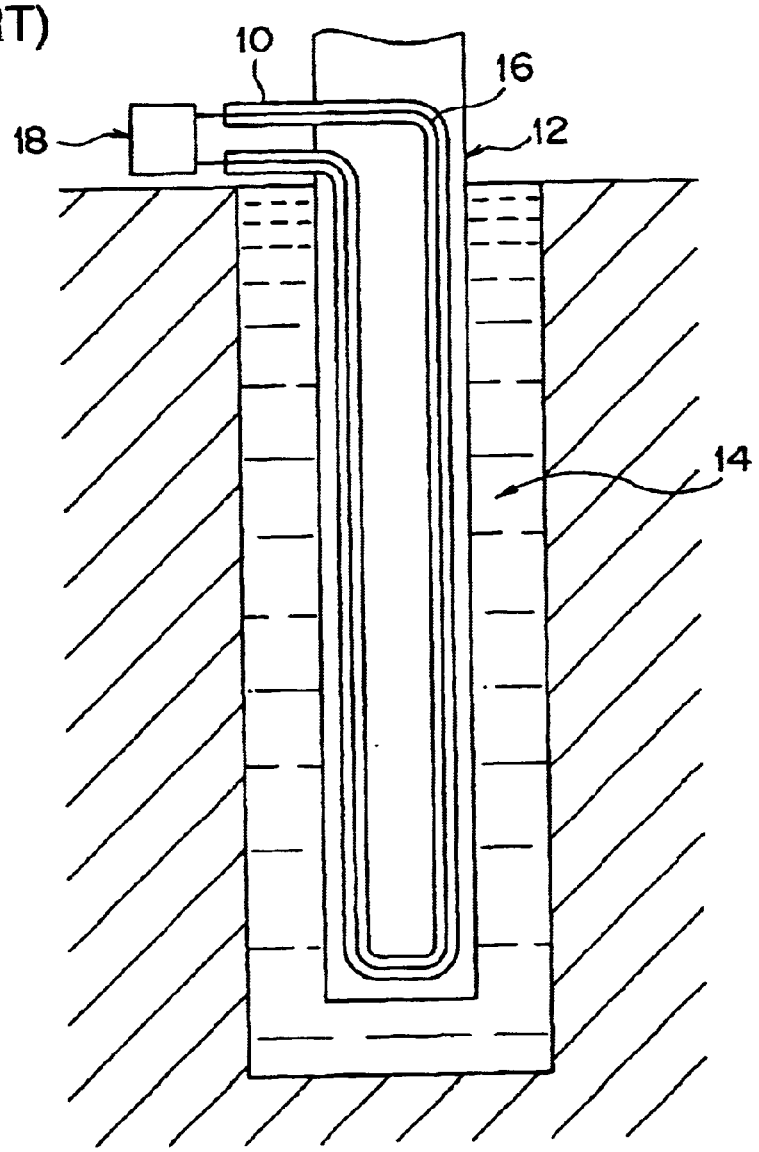
FIG. 1 (PRIOR ART)
FIGS. 1 shows a prior art temperature monitoring installation.
Figure 2:
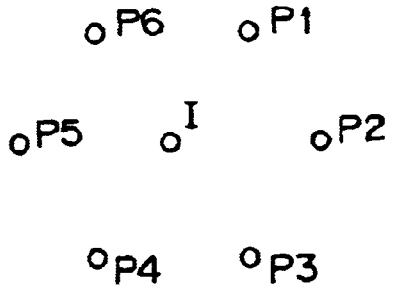
FIG. 2 (PRIOR ART)
FIG. 2 shows an example of the layout of injection and production wells in a steam flood field.

Referring now to the drawings, FIG. 2 shows one layout of wells in a steam flood secondary recovery system. A single steam injection well I is surrounded by a hexagonal arrangement of six producing wells P1–P6. Obviously the depths and separation of the wells will vary from case to case but in one known case using the arrangement of FIG. 2 the production wells are about 500 ft from the injection well. The current method of monitoring such a system is to make temperature and nuclear (water) measurements in the production wells and use this data to calibrate 4D seismic (time-lapse 3D seismic) surveys of the field to map the steam flood. The basis of the method according to the present invention is that coiled-tubing is used to drill sensor deployment holes at predetermined locations between the injector well I and the production wells P1–P6.

Figure 3:
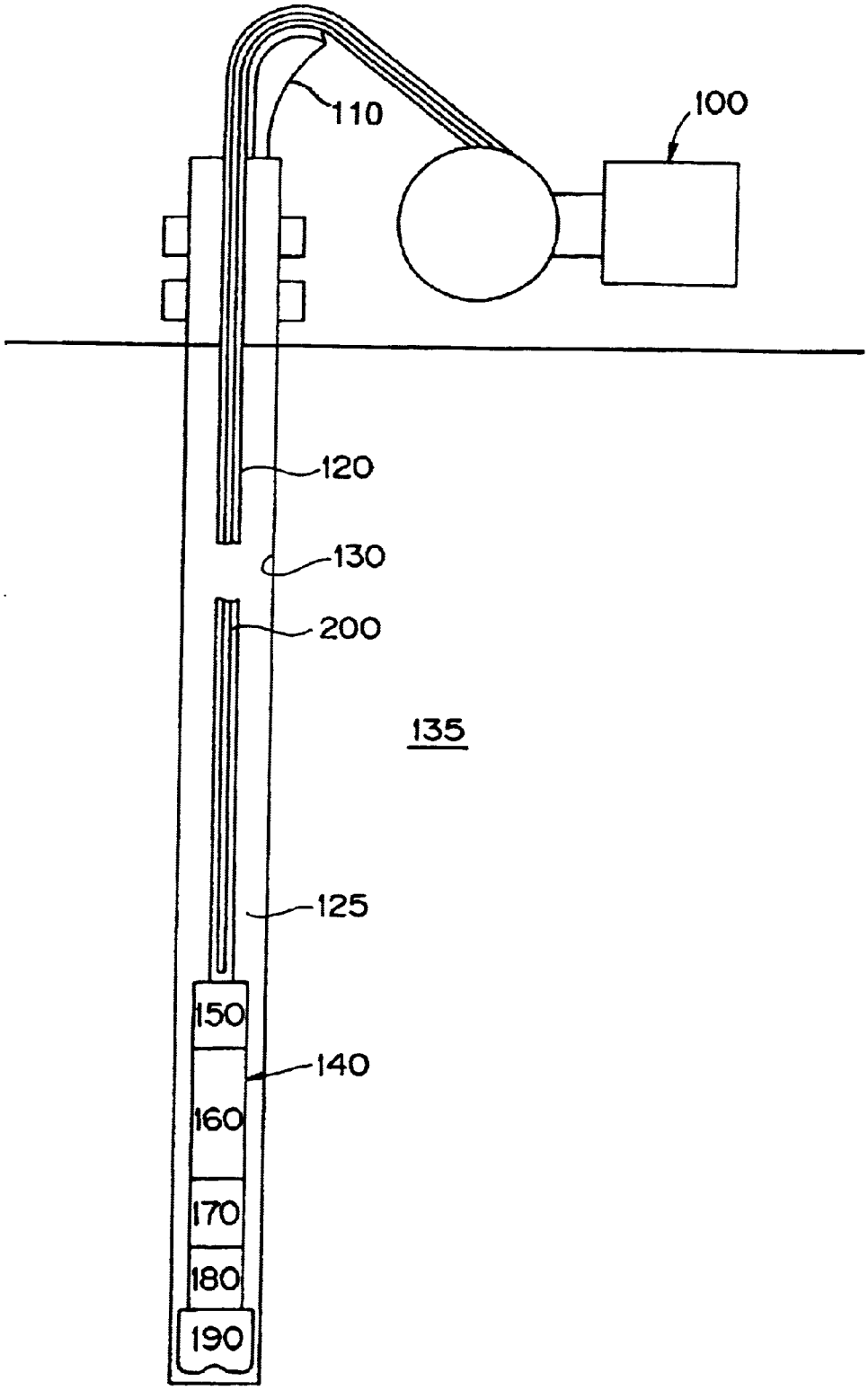
FIG. 3 shows one example of a system according to the invention for drill-in sensor placement.
Figure 4:
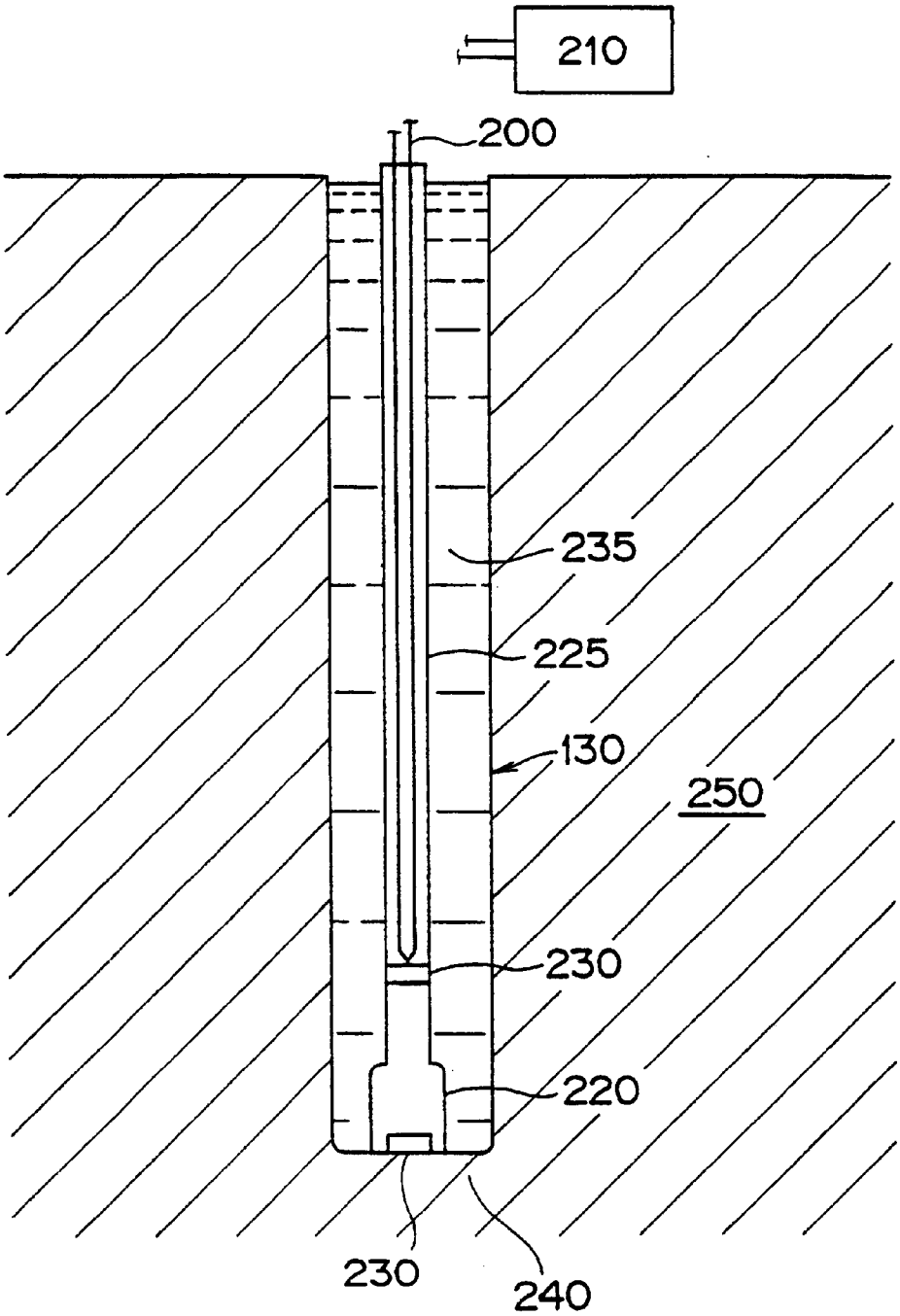
FIG. 4 shows an example of fibre optic sensor placement according to the invention.

The sensor holes are drilled using 1.5" coiled tubing using an arrangement as shown schematically in FIG. 3. This comprises a surface unit 100, optionally truck mounted, which houses the tubing reel, power supply and drilling fluid system; a tubing injector 110 including blow out preventers allowing the tubing 120 to be inserted into the hole 130 while still maintaining pressure control; and a bottom hole assembly (BHA) 140 connected to the tubing and including drilling tools and measuring instruments. For straight hole drilling, the BHA 140 comprises a connector 150 including a check valve and pressure release, drill collars 160 to provide weight on bit, MWD sub 170 for providing drilling measurements and communicating with the surface by means of mud pulse telemetry or electric line, and a mud motor 180 connected to a drill bit 190. Using this arrangement, a vertical hole can be drilled to a suitable depth in the production field, for example, 800 ft. After TD has been reached, the CT 120 carrying the BHA 140 is withdrawn from the hole 130, the BHA 140 disconnected and the CT 120 reintroduced into the hole 130. Cement is then pumped through the CT 120 to fill the annulus 125 around the CT 120-and locate it permanently in the hole 130. This provides a 1" ID cased hole which can be used to deploy a suitable sensor into the formation 135.

If it is necessary to drill a deviated hole, the BHA will also include and orienting tool and a fixed or adjustable bent housing below the mud motor (not shown). In this case, the method of completion is essentially the same as for a vertical well. In an alternative method of deployment to that described above, a hole is drilled using a CT unit until TD is reached. At this stage the tubing 120 used for drilling is withdrawn from the hole and a different completion tubing 225 inserted in its place. The completion tubing 225 can then be cemented in place by pumping cement from the surface, through the tubing 225 and into the annulus 235 in the conventional manner. Alternatively, a completion gel fluid could be used, or no cement at all, depending on the formation type being drilled.

The preferred sensor for use in a situation such as this is a continuous fibre optic temperature sensor. This sensor has a single fibre which runs to the end of the CT and back to the surface in a U shape. One end of the fibre is excited with laser light and the spectra of transmitted and reflected light measured at the ends of the fibre. Comparison of these two spectra allow determination of the temperature at all positions along the fibre. Such sensors are readily available commercially from sources such as Sensor Highway Ltd. (York Sensors), Hitachi or Ando Corp. of Japan, Smartec of Swtizerland, or Pruett Industries of USA.

Once the hole is completed the fibre 200 can be installed. In one method of installing the fibre 200, it is connected at its mid-point to a plug 230 which is bull headed by pumping fluid to carry the plug and fibre to the bottom of the well 240. The fibre 200 can be left in the well as long as is required and, when needed elsewhere, is pulled back to the surface. The fibre 200 can then be deployed in a different hole, or in the same hole 130 at a later time if required. The approach has the advantage of needing fewer fibre sensors to monitor a large number of holes, and allowing newer or different sensors to be deployed as developments in technology or requirements arise. The particularly preferred manner of fibre deployment is to provide an oversize fill joint 220 at the bottom of the tubing 225, for example the last 10 ft of the tubing 225 can be 120% of the diameter of the remaining tubing and is left open to the formation 250. When the plug 230 is pumped into the tubing 225, it falls into the fill joint at the bottom. The bottom of the hole can be open to the formation, either by removing cement or by overdisplacing cement during completion. In another case, where no cement is used, the inside of the tubing communicates with the formation via the annulus. In either case, the fluid used to pump the plug into the tubing passes into the formation.

Figure 5:
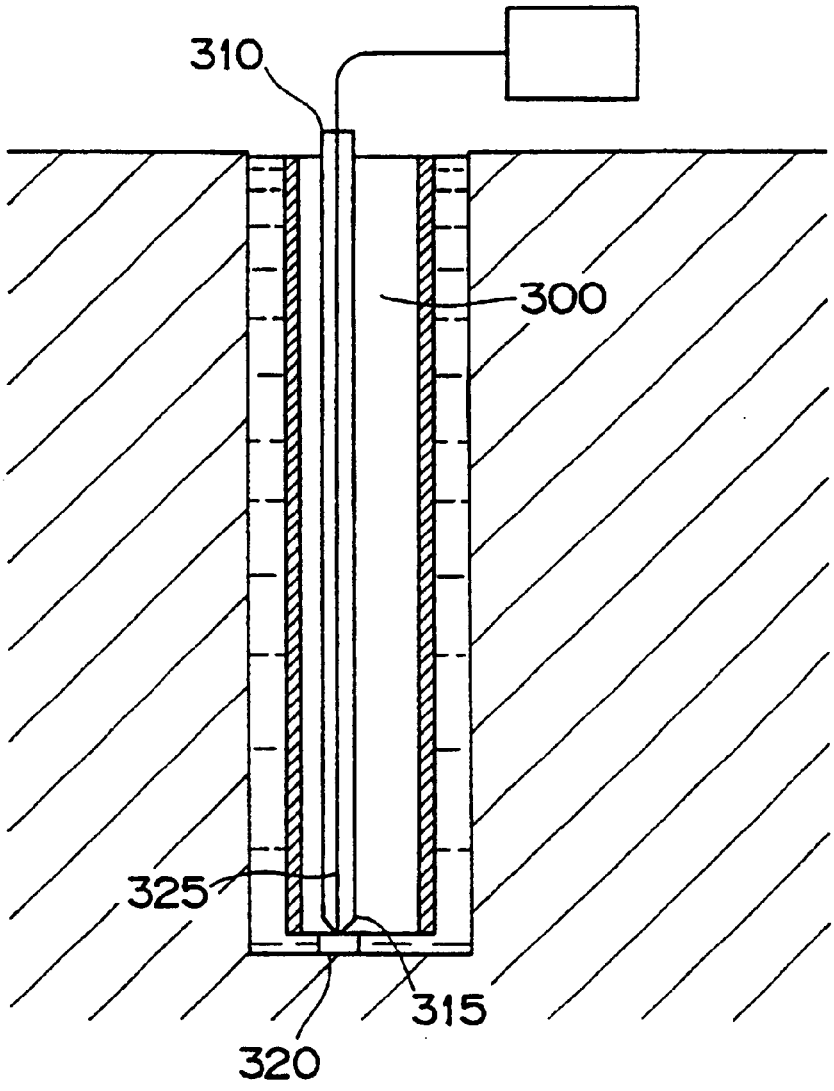
FIG. 5 shows an embodiment of the present invention.
Figure 6:
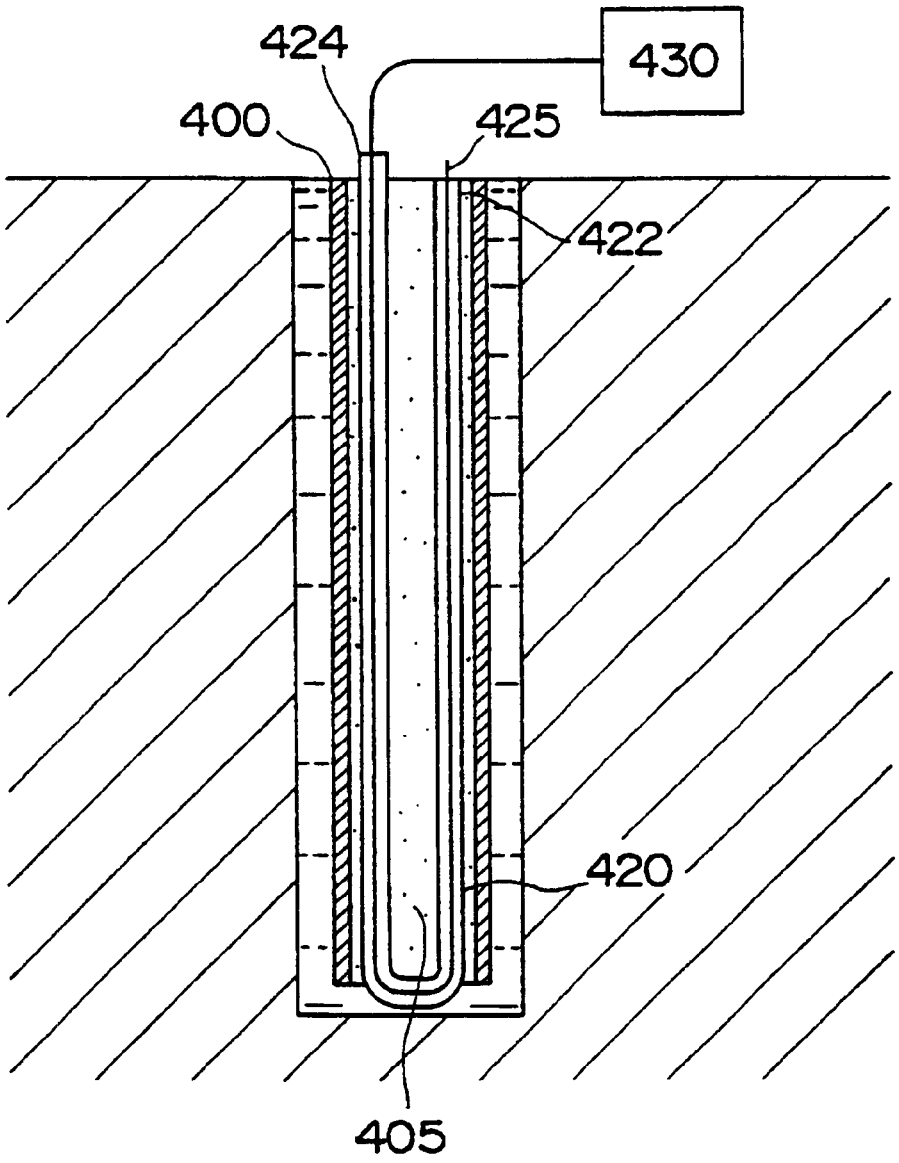
FIG. 6 shows an alternative embodiment of the present invention.

In another method of fibre deployment, the hole is drilled and completed as before, for example, typically resulting in a 1" diameter sensor placement hole 300. A smaller sensor tube 310 is then run into the completed placement hole, for example a ¼" tube. If a single sensor tube is used (see FIG. 5), its lower end 315 is left open to the interior of the placement CT 300 and is provided with a fibre optic end connector 320. The fibre optic sensor 325 is then pumped into the sensor tube 310 using a fluid until it connects with the end connector 320. Alternatively, a double, U-shaped sensor tube 420 could be used (see FIG. 6). This sensor tube, once run into the CT 400 can be "cemented" in place using a suitable gel if required 405. The fibre optic sensor 425 can then be pumped in from one end 422 until it extends to the other end 424 of the sensor tube 420 at the surface. The free end can then be connected to a suitable instrument 430 for making the appropriate physical measurement.

Alternative methods of fibre deployment can include the use of a completion tubing with the fibre already installed therein, i.e. a permanent installation. In certain cases, the tubing could be the same as that used to drill the well, the BHA being removed after TD is reached and before the hole is completed.

For measurements other than pressure, a different completion method may be required, using, for example, a gel like completion fluid is it is desired to transmit pressure to the optical fibre. One use of such a system is to monitor tectonic movements as is often done in earthquake monitoring. Sensors other than optical fibres can also be used and can be logged through the tubing in the manner of other through casing logging tools. The number, depth and distribution of the holes will depend on the type of measurement being made. CT drilled wells can be significantly cheaper than conventional rotary rig-drilled wells. Coiled tubing is likewise cheaper than regular casing. Also, the ability to use a CT unit instead of a conventional rig means that generally each hole will be cheaper and relatively quick to complete. Therefore, the sensor installations described above can be effectively disposable, new holes being drilled as the flood front progresses. Consequently, the invention also provides a method for monitoring the progress of a flood front, comprising placing a series of drill-in sensor holes along the direction of movement of the flood front. As the movement is monitored, new holes can be drilled according to the determinations made from earlier measurements.

One method of long term monitoring of subsurface properties according to the invention comprises drilling and completing a number of sensor holes in the manner described above at locations throughout a reservoir which has a number of injection and production wells such as are shown in the arrangement of FIG. 2. As production continues over a period of time, a time series of seismic measurements are mode of the reservoir (time-lapse seismic monitoring). At the same time, a series of temperature measurements are made using the sensor holes described above to monitor temperature development and hence steam flood front movement in the reservoir. Furthermore, a series of seismic check shot surveys can be made from the production wells and the three sources of data (surface time-lapse seismic, temperature and check shot seismic) integrated to provide a more accurate indication of the development of the steam front, and identify pockets of unswept oil. Thus a program of in-fill drilling can be proposed which more accurately addresses missed pockets of oil to optimise reservoir production.

INDUSTRIAL APPLICABLITIY

The present invention finds application in the field of monitoring underground formations, particularly hydrocarbon reservoirs and the like.

What is claimed:

1. A method of monitoring subsurface formation properties between injection and production wells, comprising:

(i) drilling during secondary recovery a borehole (300) into the underground formation at a predetermined position between the injection and production wells using a coiled tubing apparatus; and (ii) completing the borehole so as to retain a coiled tubing therein to provide a conduit for positioning a sensor (310) in the formation and providing communication from the sensor to the surface, wherein the steps of drilling and completing a borehole are performed at more than one location between the injection and production wells.

2. A method as claimed in claim 1, wherein the step of drilling a borehole is accomplished by using a bottom hole assembly connected to the coiled tubing, the bottom hole assembly including drilling tools and measurement equipment.

3. A method as claimed in claim 2, wherein the sensor is positioned in the coiled tubing used to drill the hole and after drilling the borehole, the coil tubing is withdrawn and the bottom hole assembly removed therefrom and the coiled tubing returned to the borehole carrying the sensor.

4. A method as claimed in claim 2, wherein the borehole is completed with the coil tubing carrying the bottom hole assembly remaining in the borehole.

5. A method as claimed in claim 1, wherein the same coil tubing is used for drilling the borehole as is used to position the sensor.

6. A method as claimed in claim 1, wherein different coil tubings are used to drill the borehole and position the sensor.

7. A method as claimed in claim 1, wherein the step of completing the borehole includes pumping a cementing fluid through the coiled tubing so as to fill the space between the outer part of the tubing and the borehole wall and secure the tubing in the borehole.

8. A method as claimed in claim 1, wherein the sensor is located in the coiled tubing before it is positioned in the borehole.

9. A method as claimed in claim 1, wherein the sensor is installed in the coiled tubing after the coiled tubing has been retained in the borehole.

10. A method as claimed in claim 9, wherein the sensor is installed in the coiled tubing by first running a smaller diameter sensor tube into the coiled tubing and then pumping the sensor into the sensor tube from the surface.

11. A method as claimed in claim 10, wherein the sensor tube is a single tube, a sensor end connector being provided at its lower end to secure the end of the sensor when it is pumped into the hole.

12. A method as claimed in claim 10, wherein the sensor tube comprises a double, U-shaped tube, open ends of which are located at the surface, the sensor being pumped from one end of the tube through to the other end so as to run the length of the hole twice.

13. A method as claimed in claim 12, wherein the sensor tube is located in the coiled tubing using a gel.

14. A method as claimed in claim 1, comprising positioning the same sensor at a number of locations between the injection well and the production well.

15. A method as claimed in claim 1 wherein the sensor comprises a fibre optic temperature sensor, a pressure sensor or a seismic sensor.

16. A method of monitoring the development over time of subsurface formations properties between injection and production wells comprising:

(i) drilling during secondary recovery a borehole in the subsurface formation in an expected region of development of the properties using a coiled tubing drilling apparatus; and (ii) completing the borehole so as to retain a coiled tubing therein to provide a conduit for positioning a sensor in the formation to measure the properties and providing communication from the sensor to the surface, wherein the steps of drilling and completing a borehole are performed (at more than one location between the injection and production wells.

17. A method as claimed in claim 16 further comprising (iii) deploying a temperature sensor into coiled tubing and measuring at least one subsurface formation property, and (iv) integrating said measurement with a time-series of seismic measurements, and (v) determining development over time of subsurface formation properties.

18. A method of monitoring subsurface properties between injection and production wells, comprising:

(i) drilling a borehole into the underground formation at a predetermined position between injection and projection wells using a coiled tubing drilling apparatus;

(ii) completing the borehole as to retain a coiled tubing therein to provide a conduit for positioning a sensor in the formation and providing communication from the sensor to the surface, wherein said sensor is a continuous fibre optic sensor, and (iii) deploying sensor into coiled tubing in the borehole, making a measurement, and retracting sensor from the borehole to the surface, wherein the steps of drilling and completing a borehole and deploying a sensor are performed at more than location between the injection and production wells.

19. A method as claimed in claim 18 wherein the step of deploying is repeated at a later time.

20. A method as claimed in claim 18 wherein the step of deploying using the same sensor.

* * * * *